US010548399B2

(12) United States Patent
Humphreys et al.

(10) Patent No.: US 10,548,399 B2
(45) Date of Patent: Feb. 4, 2020

(54) RECLINING COLLAPSIBLE CHAIR

(71) Applicant: Cabela's LLC, Sidney, NE (US)

(72) Inventors: Luke Humphreys, Sidney, NE (US); Robert Shaw, Sidney, NE (US); Thomas Martin, Sidney, NE (US)

(73) Assignee: CABELA'S LLC, Sidney, NE (US)

( * ) Notice: Subject to any disclaimer, the term of this patent is extended or adjusted under 35 U.S.C. 154(b) by 28 days.

(21) Appl. No.: 15/704,764

(22) Filed: Sep. 14, 2017

(65) Prior Publication Data

US 2018/0070728 A1 Mar. 15, 2018

Related U.S. Application Data

(60) Provisional application No. 62/394,347, filed on Sep. 14, 2016.

(51) Int. Cl.

| | |
|---|---|
| ***A47C 4/00*** | (2006.01) |
| ***A47C 3/02*** | (2006.01) |
| ***A47C 3/027*** | (2006.01) |
| ***A47C 4/02*** | (2006.01) |
| *A47C 3/025* | (2006.01) |

(52) U.S. Cl.

CPC ..... *A47C 3/027* (2013.01); *A47C 4/02* (2013.01); *A47C 3/0257* (2013.01)

(58) Field of Classification Search

CPC ..... A47C 3/027; A47C 3/029; A47C 3/03; A47C 3/02; A47C 3/021; A47C 3/023; A47C 3/025; A47C 3/0252; A47C 3/0255; A47C 3/026; A47C 3/0257; A47C 3/18; A47C 1/027; A47C 4/02; A47C 5/10; A47C 1/032; A47C 1/024; A47D 13/10; A47D 13/102; A47D 13/105; A47D 13/107; A47D 9/04

USPC ..... 297/259.1, 259.2, 259.3, 261.1, 261.2, 297/261.3, 263.1, 269.1, 270.1, 271.6, 20, 297/316, 317, 322, 325, 329, 341, 342

See application file for complete search history.

(56) References Cited

U.S. PATENT DOCUMENTS

| | | | | | |
|---|---|---|---|---|---|
| 3,999,799 | A * | 12/1976 | Daswick | A47C 3/0257 | 297/270.3 |
| 4,101,168 | A * | 7/1978 | Ferro | A47C 1/0242 | 248/430 |
| 4,941,709 | A * | 7/1990 | Moller | A61B 6/04 | 297/311 |
| 5,024,484 | A * | 6/1991 | Buchacz | A47C 3/20 | 297/300.3 |

(Continued)

*Primary Examiner* — Kyle J. Walraed-Sullivan

(74) *Attorney, Agent, or Firm* — Pillsbury Winthrop Shaw Pittman LLP

(57) ABSTRACT

A collapsible chair may be supported by a base. A slider receptacle may be mounted on the base and comprise two arched slider receiving areas. Each arched slider receiving area may be shaped as an arched guide, track or hollow cylinder suitable for receiving two arched sliders, where each arched slider may be inserted and adjustably moved by hand in one of the two arched slider receiving areas. Moving the arched sliders towards a front of the collapsible chair reclines the collapsible chair while moving the arched sliders towards a rear of the collapsible chair raises the collapsible chair. The collapsible chair may also have two back rest poles and two seat poles that create the frame of the collapsible chair. A material may be extended between distal ends of the two back rest poles and two seat poles to create a seating area of the collapsible chair.

18 Claims, 9 Drawing Sheets

(56) References Cited

U.S. PATENT DOCUMENTS 5,967,609 A * 10/1999 Potter ..... A47C 1/027 297/261.3
6,106,065 A * 8/2000 Carroll ..... A47C 1/0347 297/325
6,450,578 B1 * 9/2002 Taggett ..... A47C 1/0347 297/173
6,840,573 B1 * 1/2005 Yao ..... A47C 4/02 297/16.1
7,000,983 B1 * 2/2006 Tsai ..... A47C 4/50 297/56
7,007,965 B2 * 3/2006 Bernatsky ..... A61G 5/12 280/304.1
D645,264 S * 9/2011 Wiegmann ..... D6/339
8,235,407 B2 * 8/2012 Cerreto ..... A61G 5/1075 280/250.1
8,936,315 B2 * 1/2015 Fienup ..... A61B 3/024 297/330
9,908,628 B2 * 3/2018 Le ..... B64D 11/064
2002/0149244 A1 * 10/2002 Wilkens ..... A47C 3/029 297/270.5
2004/0031097 A1 * 2/2004 Kane ..... A47D 13/102 5/105
2006/0284463 A1 * 12/2006 Gelo ..... A47C 3/0257 297/329
2009/0256406 A1 * 10/2009 Schrooten ..... B60N 2/2821 297/256.16
2011/0160026 A1 * 6/2011 Perez, Jr. ..... A47C 3/0252 482/142
2013/0069397 A1 * 3/2013 Homans ..... A47C 4/02 297/16.1
2014/0265490 A1 * 9/2014 Hopke ..... A47D 9/02 297/260.2
2014/0306502 A1 * 10/2014 Manuel ..... A47C 3/0257 297/261.1
2015/0189994 A1 * 7/2015 Lee ..... A47C 3/18 297/16.1
2015/0335136 A1 * 11/2015 Wehner ..... A45F 3/26 297/273
2017/0065101 A1 * 3/2017 Tadipatri ..... A47D 9/04
2017/0251830 A1 * 9/2017 Sclare ..... A47D 9/02
2017/0280891 A1 * 10/2017 Mountz ..... A47D 13/105
2018/0035806 A1 * 2/2018 Yang ..... A47C 4/42

* cited by examiner

RECLINING COLLAPSIBLE CHAIR

CROSS-REFERENCE TO RELATED APPLICATIONS

This application claims priority to provisional application No. 62/394,347 filed on Sep. 14, 2016.

FIELD OF THE INVENTION

The present invention generally relates to a reclining collapsible chair that may be used, as examples, for camping and hunting.

BACKGROUND OF THE INVENTION

Collapsible chairs provide a seating option for people during outdoor activities, where seating options might not otherwise be available. As collapsible chairs are often carried by people considerable distances, such as during a hike, collapsible chairs are preferably lightweight. In addition, collapsible chairs are preferably collapsible to make it easier for the person carrying the collapsible chair to place the collapsed chair in a sleeve or backpack.

However, in creating collapsible chairs that are both lightweight and collapsible, collapsible chairs are notoriously uncomfortable and typically have very few or no adjustments. Thus, it is desirable to improve the comfort of sitting in a collapsible chair, while maintaining the collapsible chair's lightweight and collapsibility.

SUMMARY OF THE INVENTION

The present invention provides a reclining collapsible chair. The collapsible chair may have a base for resting on the ground and supporting the collapsible chair and user. The base may have a plurality of legs (preferably three or four) and a leg receptacle. A first end of each of the legs may be inserted into and removed from the leg receptacle. In preferred embodiment the legs may be inserted and removed by hand without requiring the use of any tools. A second end of each of the plurality of legs may rest upon the ground to support the base during use. Each leg may comprise one or more pieces that telescope or fit inside each other.

The collapsible chair may also have a slider receptacle mounted on the base. The slider receptacle preferably has, as a non-limiting example, two arched slider receiving areas. Each arched slider receiving area may be a hollow cylinder, guide or track that allows an arched slider to slide within the arched slider receiving area in a forward and backward direction of the collapsible chair. The hollow cylinder, guide or track is preferably arched or curved to match an arched slider.

The collapsible chair also preferably includes two arched sliders. Each arched slider may comprise an elongated arched pole configured to be inserted and adjustably moved or slid by hand in one of the two arched slider receiving areas of the slider receptacle.

The collapsible chair may also include two back rest poles. Each back rest pole may comprise an elongated pole configured to form a back rest of the collapsible chair. A first end of each back rest pole may be connected by a back rest connector to the two arched sliders.

The collapsible chair may also include two seat poles. The seat poles may form a frame or structure for a seat of the collapsible chair when a first end of each seat pole is connected by a seat connector to the two arched sliders.

Finally, a mesh material may be extending between a second end of each back rest pole and a second end of each seat pole to form a sitting area for the collapsible chair. In preferred embodiments, four sleeves are created at the corners of the mesh material. The sleeves may be placed over the distal ends of each back rest pole and each set pole to hold the mesh material in place.

The above features and advantages of the present invention will be better understood from the following detailed description taken in conjunction with the accompanying drawings.

DETAILED DESCRIPTION

Figure 1:
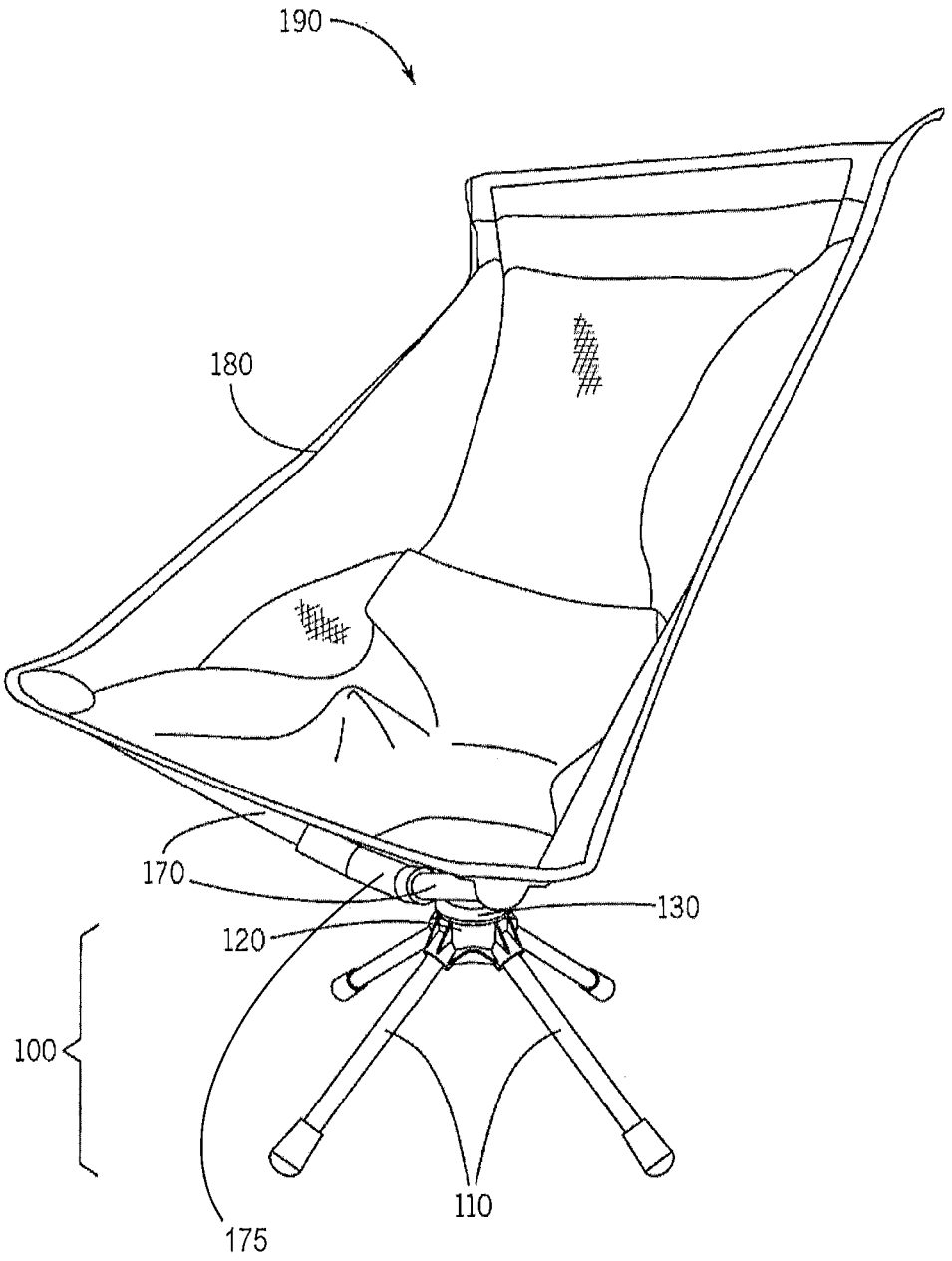
FIG. 1 is an illustration of a front-side view of a collapsible chair according to an embodiment of the invention.
Figure 2:
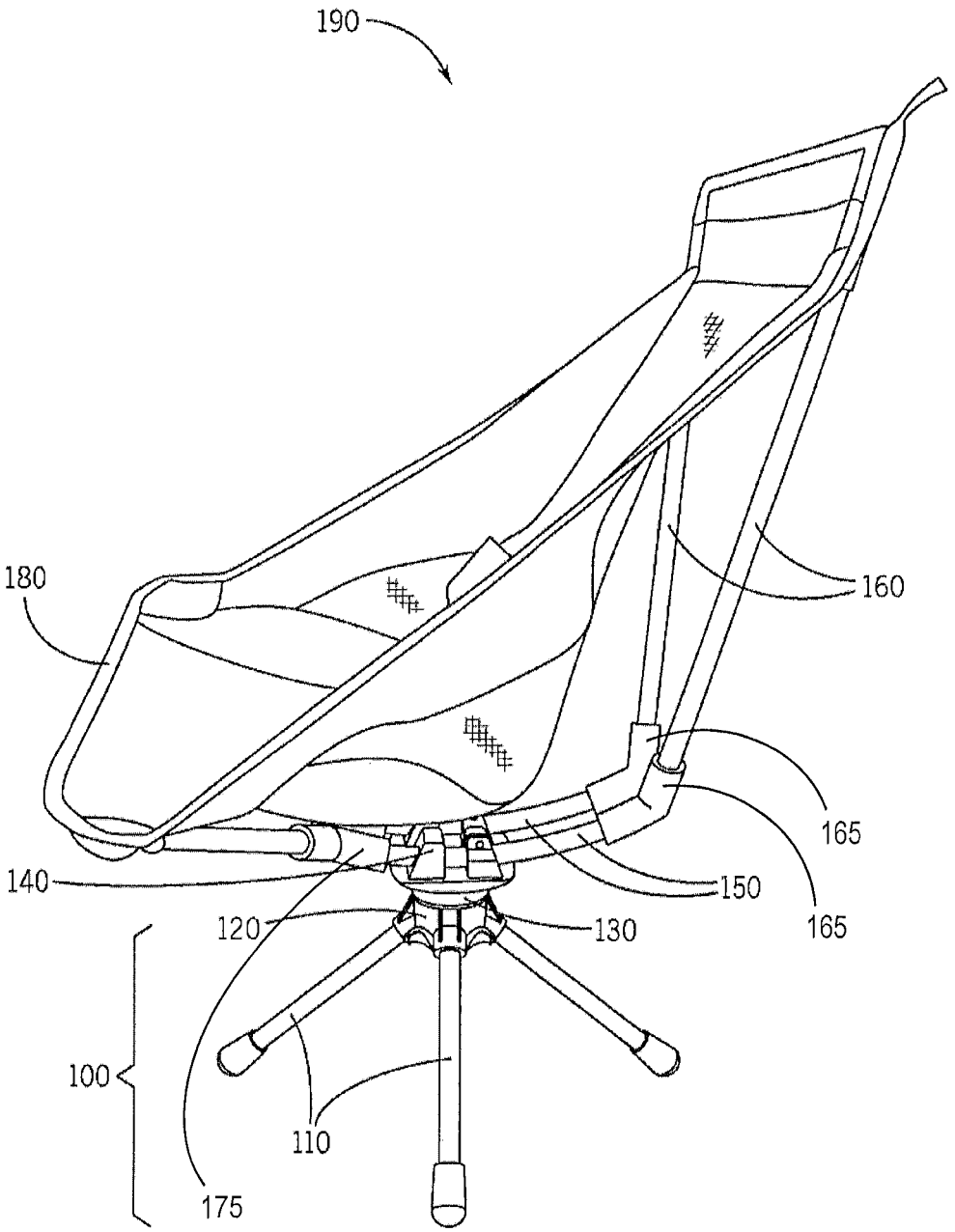
FIG. 2 is an illustration of a side view of a collapsible chair according to an embodiment of the invention.
Figure 3:
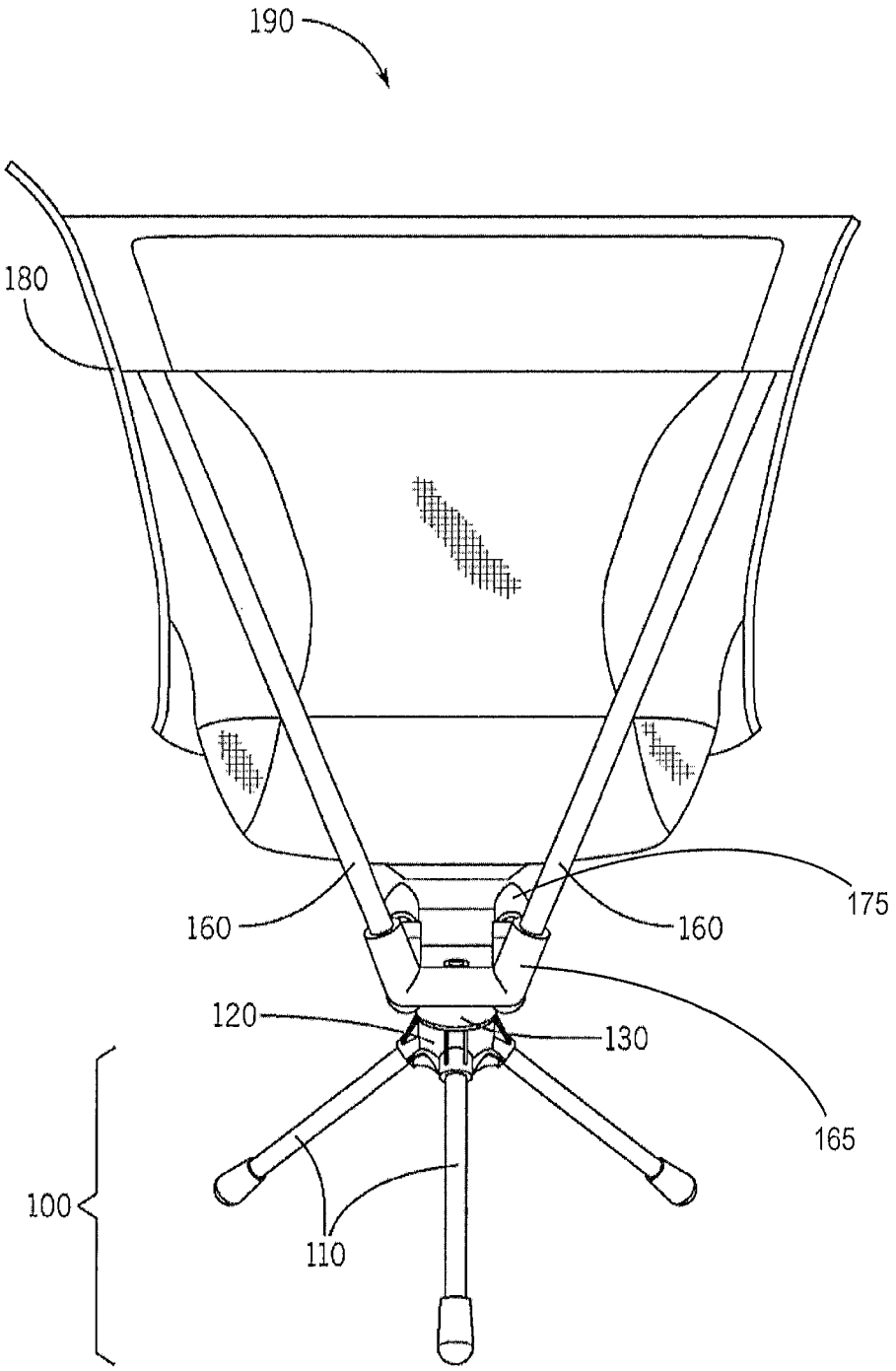
FIG. 3 is an illustration of a back view of a collapsible chair according to an embodiment of the invention.
Figure 4:
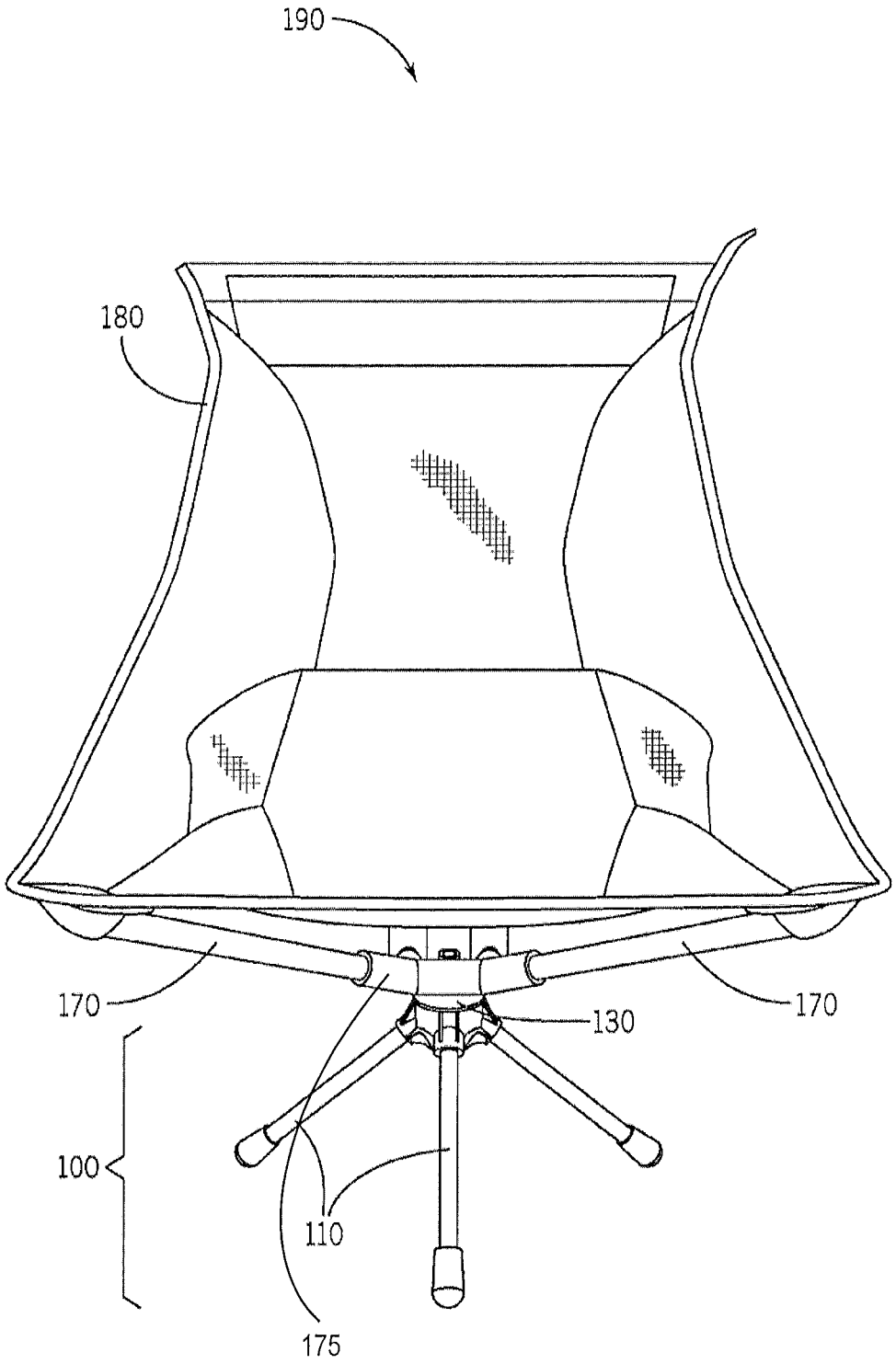
FIG. 4 is an illustration of a front view of a collapsible chair according to an embodiment of the invention.

The present inventions will now be discussed in detail with regard to the attached drawing figures that were briefly described above. In the following description, numerous specific details are set forth illustrating the Applicant's best mode for practicing the invention and enabling one of ordinary skill in the art to make and use the invention. It will be obvious, however, to one skilled in the art that the present invention may be practiced without many of these specific details. In other instances, well-known machines, structures, and method steps have not been described in particular detail in order to avoid unnecessarily obscuring the present invention. Unless otherwise indicated, like parts and method steps are referred to with like reference numerals.

Referring to FIGS. 1-4, a collapsible chair 190 may have a base 100 for supporting the collapsible chair 190 off of the ground. In preferred embodiments, the base 100 may have three or four legs 110. One end of each leg 110 may be designed to be inserted into (during use) and removed (when collapsing in preparation for storage or transportation) by hand from a leg receptacle 120. The legs 110 may be of any desired length, but are preferably between six inches and three feet in length. The legs 110 may comprise one or more pieces. If the legs 110 comprise more than one piece, the pieces preferably have an internal elastic cord that attaches the pieces of each leg 110 together. This keeps the pieces of each leg together during transportation or when the chair is disassembled.

The plurality of legs 110 and the leg receptacle 120 may be made of any desirable material that is preferably strong and lightweight. As non-limiting examples, the legs 110 and leg receptacle 120 may be made of plastic or aluminum. The end of the legs 110 touching the ground may have a protective plastic or rubber cover or coating to protect the legs 110 while contacting the ground. The protective cover or coating may also provide a larger surface area for the end of the leg 110 to make it less likely the end of the leg 110 will be driven into the ground during use.

Each leg 110 may have an internal elastic cord that attaches the leg 110 to the leg receptacle 120. The internal elastic cords may prevent the legs 110 from getting lost when the chair is in the collapsed state. Each internal elastic cord is preferably able to sufficiently stretch by hand to allow an end of the leg 110 to be inserted into the leg receptacle 120 during use and allow the end of the leg 110 to be removed from the leg receptacle 120 for storage or transportation. In preferred embodiments, each elastic cord is able to stretch three or four inches.

The collapsible chair 190 may also have a slider receptacle 130 mounted on the base 100. The slider receptacle 130 may be configured to rotate or swivel in relation to the base 100 or the slider receptacle 130 may be configured to maintain its position with respect to the base 100. Allowing the slider receptacle 130 to rotate or swivel with relation to the base 100 allows a user to rotate or swivel the collapsible chair 190 from side to side. A slider receptacle 130 that maintains its position with respect to the base 100 will prevent the collapsible chair 190 from being able to swivel and will provide a stable seating position.

The slider receptacle 130 may further comprise one, two or more arched slider receiving areas 140. The invention is illustrated in FIGS. 1-4 with two arched slider receiving areas 140 and two arched sliders 150. Each arched slider receiving area 140 may be configured to allow an arched slider 150 to only be able to slide towards the front of the chair or slide towards the rear of the chair. The arched slider receiving areas 140 preferably prevent the arched sliders 150 from moving up or down and also prevent the arched sliders 150 from moving side to side. Each arched slider receiving area 140 may be one or more guides, tracks or hollow cylinders that allow each arched slider 150 to move forwards and backwards, while otherwise holding the arched sliders 150 in position.

The slider receptacle 130 and arched slider receiving areas 140 may be made of any material, but are preferably made of, as non-limiting examples, a hard plastic or a lightweight metal, such as aluminum.

The collapsible chair 190 may also comprise one or more arched sliders 150, but preferably comprises two arched sliders 150. The arched sliders 150 may be elongated arched poles that are configured to be inserted and adjustably moved by hand in an arched slider receiving area 140 of the slider receptacle 130. The arched sliders 150 and arched slider receiving areas 140 may be designed, shaped and sized together so that the arched sliders 150 are guided and slide through the arched slider receiving areas 140 in either a forward or backward direction. Moving the arched sliders 150 forward will tend to recline the collapsible chair 190 so that a user would be in a more horizontal position, while moving the arched sliders 150 backwards will tend to raise the collapsible chair 190 so that a user would be in a more vertical position.

Figure 8:
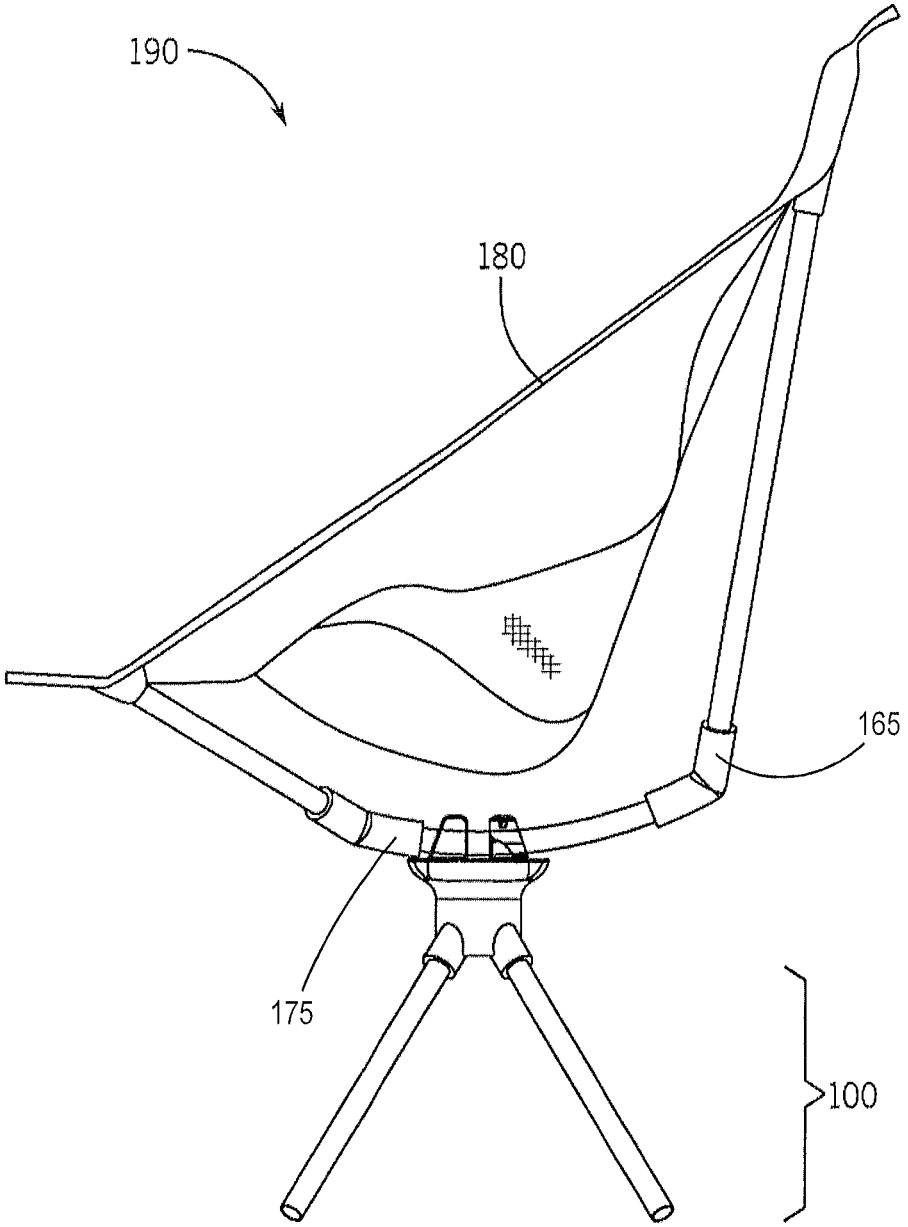
FIG. 8 is an illustration showing a collapsible chair in an upright position.
Figure 9:
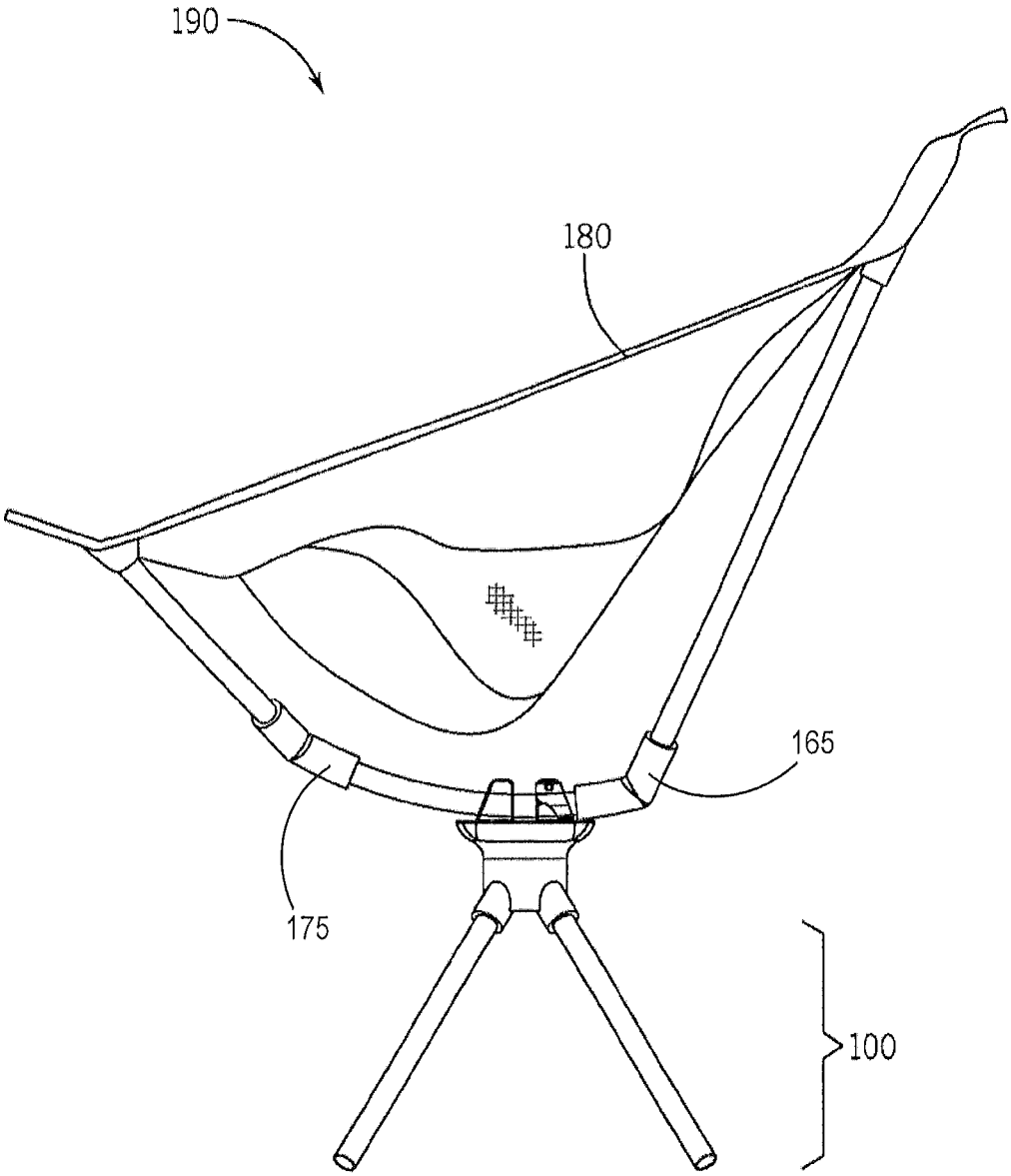
FIG. 9 is an illustration showing a collapsible chair in a reclined or horizontal position.

The arched sliders 150 are preferably generally shaped like an arc of a circle. The length of the arc and the size of the circle that corresponds to the arc may be selected as desired for the arched sliders 150. As non-limiting examples, the arched sliders 150 are preferably shaped like an arc of a circle having a radius of between 3 inches and 25 inches and most preferably a radius of 5 inches. In preferred embodiments, the arched sliders 150 are not straight, but arched so that the chair 190 either reclines (as shown in FIG. 9) or sit-ups (as shown in FIG. 8) depending on the position of the arched sliders 150 within the slider receptacles 130.

The amount the arched sliders 150 are arched or curved determines how far the collapsible chair 190 will recline or rise given a corresponding forward or backward movement of the arched sliders 150 relative to the arched slider receiving areas 140. A larger arch (smaller circle) or curve in the arched sliders 150 will result in the collapsible chair 190 reclining or rising further or faster than for a smaller arch (bigger circle) or curve for the same amount of movement of the arched sliders 150 relative to the arched slider receiving areas 140. The arched sliders 150 are preferably all arched the same amount.

The arched sliders 150 may be made of any material, but are preferably made of, as non-limiting examples, hard plastic or a lightweight metal, such as aluminum. The arched sliders 150 may be any desired length, but are preferably between one and three feet long, and preferably about two feet long.

The collapsible chair 190 may also have one or more, and preferably two, back rest poles 160. The back rest poles 160 may be elongated poles that are two to four feet in length made of, as a non-limiting example, aluminum. The back rest poles 160 may be a single piece or may be made of two or more pieces to allow the back rest poles 160 to be further collapsed. The back rest poles 160 are preferably connected to the arched sliders 150 via a back rest connector 165. In a preferred embodiment, the back rest connector 165 has two receptacles for receiving two arched sliders 150 and two receptacles for receiving two back rest poles 160. The back rest poles 160 will be in a more vertical position when the collapsible chair 190 is in the raised position (shown if FIG. 8) and will be in a more horizontal position when the collapsible chair 190 is in a reclined position (shown in FIG. 9).

In preferred embodiments, the back rest poles 160 may be removed from the back rest connector 165 to collapse the collapsible chair 190 during storage or transportation. An elastic cord may be connected between each back rest pole 160 and the back rest connector 165 (and between a plurality of pieces of the back rest pole 160 if the back rest pole 160 is made of the plurality of pieces) to reduce the risk of loss of the back rest pole 160 and/or the back rest connector 165.

The collapsible chair 190 may also have one or more, and preferably two, seat poles 170. The seat poles 170 may be elongated poles that are preferably about six inches to two feet in length made of, as non-limiting examples, plastic or aluminum. The seat poles 170 are preferably connected to the arched sliders 150 via a seat connector 175. In a preferred embodiment, the seat connector 175 has two receptacles for receiving two arched sliders 150 and two receptacles for receiving seat poles 170. The seat poles 170 will be more horizontal when the collapsible chair 190 is in the raised position (shown in FIG. 8) and will be more vertical when the collapsible chair 190 is in a reclined position (shown in FIG. 9).

In preferred embodiments, the seat poles 170 may be removed from the seat connector 175 to collapse the collapsible chair 190 during storage or transportation. An elastic cord may be connected between each seat pole 170 and the seat connector 175 to reduce the risk of loss of the seat pole 170 and/or the seat connector 175.

A material 180, which may be, as non-limiting examples, canvas or a mesh material, may be extended from a distal end of each of the back rest poles 160 and from a distal end of each of the seat poles 170. The material 180 may be shaped to form a sitting area of the collapsible chair 190.

Figure 5:
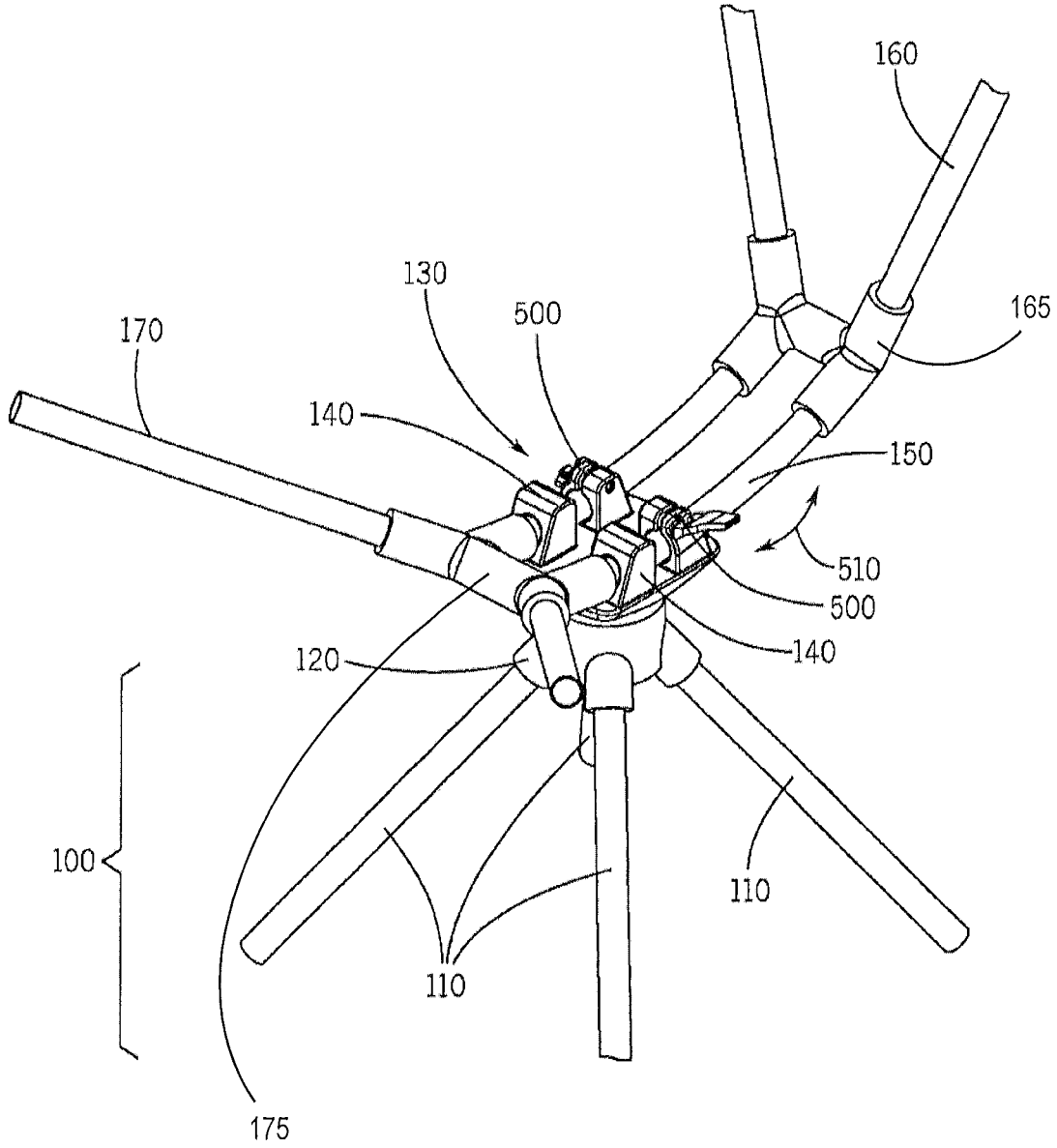
FIG. 5 is an illustration of a base connected to a slider receptacle comprising two arched slider receiving areas with two arched sliders in the arched slider receiving areas wherein the two arched sliders may slide (when not locked into place) within the arched slider receiving areas to move the collapsible chair between an upright position and a horizontal position.
Figure 6:
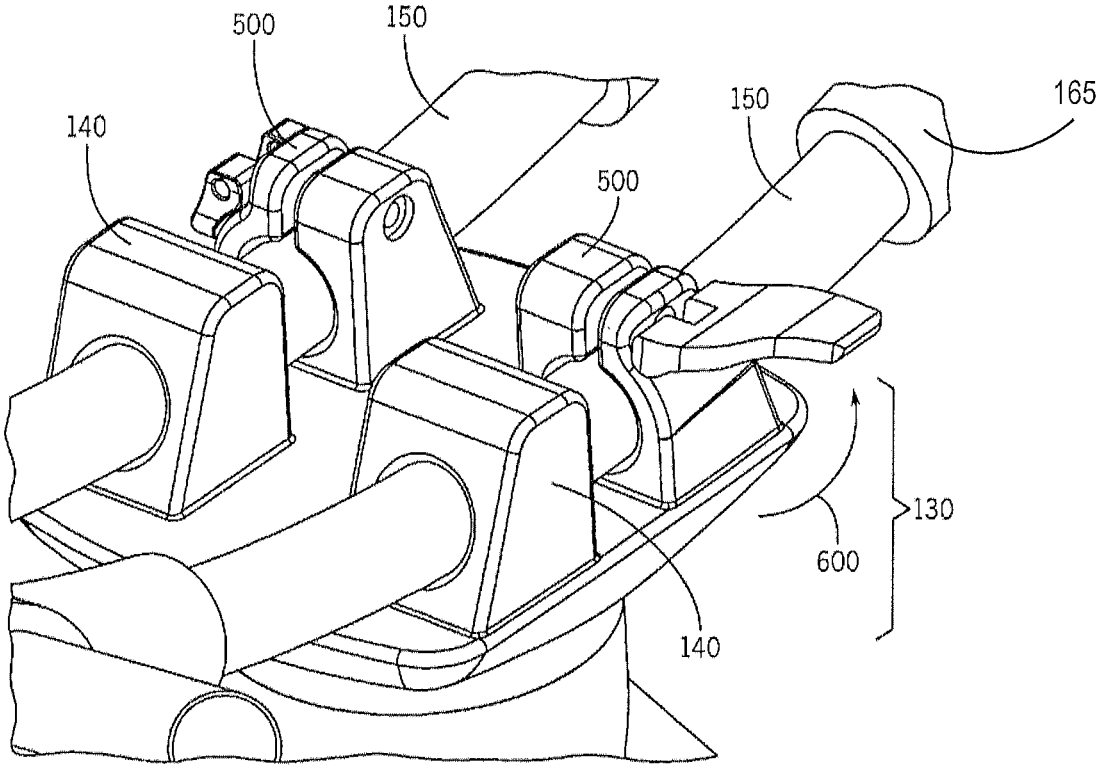
FIGS. 6 and 7 are illustrations of a close up a slider receptacle showing two arched slider receiving areas and two locking mechanisms retaining two arched sliders.
Figure 7:
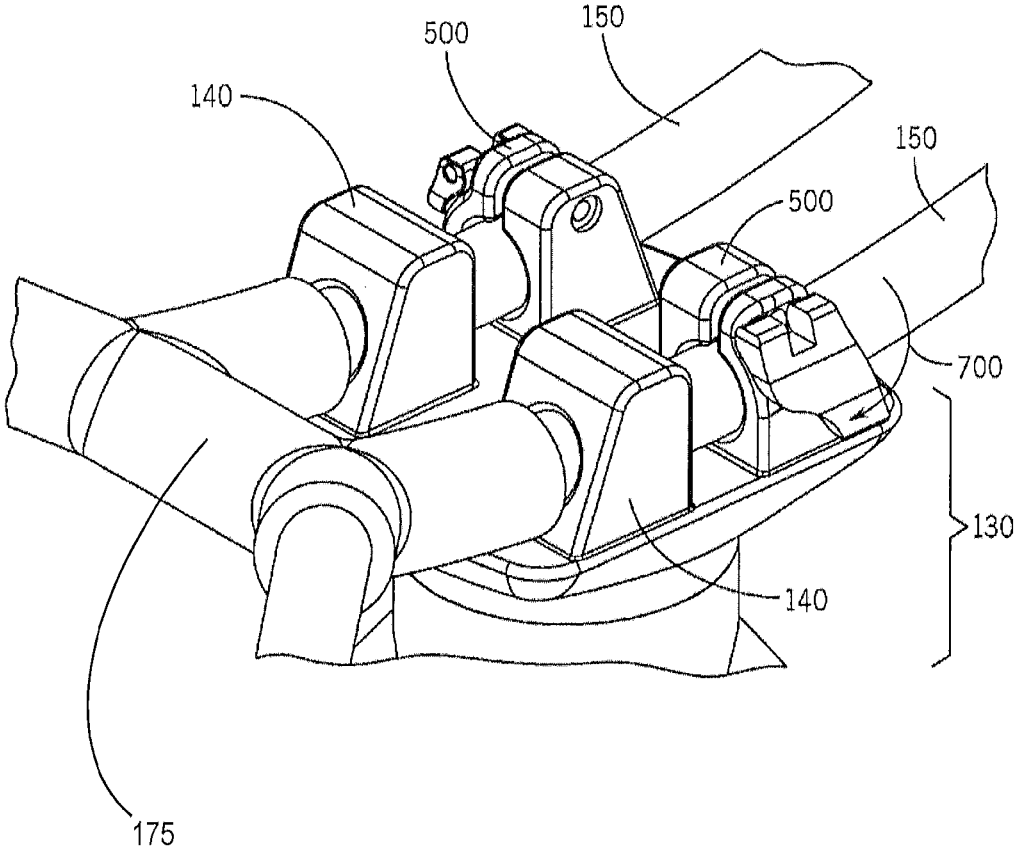

An example method of using and practicing the invention will now be discussed with reference to FIGS. 1-9. Once the collapsible chair 190 has been fully assembled as illustrated in FIGS. 1-4 and FIGS. 8-9, a person using the collapsible chair 190 may adjust the tilt or position of the collapsible chair 190 by unlocking one or more locking mechanisms 500. A non-limiting example of two locking mechanisms 500 is illustrated in FIGS. 5-7. It should be noted that the collapsible chair 190 in FIGS. 5-7 is illustrated without the seat material 180 so that the slider receptacle 130 with its two arched slider receiving areas 140 and the arched sliders 150 may be more clearly seen and illustrated. In actual use, the seat material 180 is preferably covering the collapsible chair frame as illustrated in FIGS. 1-4 during use.

Each locking mechanism 500 may be locked and/or unlocked using any desired locking and unlocking mechanism. When the locking mechanism 500 is locked, the arched slider 150 will not be able to freely slide within the arched slider receiving area 140. In contrast, when the locking mechanism 500 is open or unlocked, the arched slider 150 may be able to be slid by hand back and forth within the arched slider receiving area 140. This allows the chair to be moved between an upright and a reclined position.

As a non-limiting example, the locking mechanism 500 may be unlocked by raising a tab on the locking mechanism 500 in the direction indicated by arrow 600 in FIG. 6. For the example illustrated locking mechanism 500, raising the tab on the locking mechanism 500 may expand the locking mechanism 500 to thereby allow an arched slider 150 to slide back and forth within the locking mechanism 500 and the arched slider receiving area 140.

With the locking mechanism 500 unlocked or open, the person using the collapsible chair 190 may slide each arched slider 150 back and forth in a corresponding arched slider receiving area 140 of the slider receptacle 130. The back and forth movement of the arched sliders 150 in the arched slider receiving areas 140 is indicated by arrow 510 in FIG. 5 and may be used to adjust the tilt or position of the collapsible chair 190.

When the arched sliders 150 are slid in the arched slider receiving areas 140 of the slider receptacle 130 towards the back of the collapsible chair 190, the collapsible chair 190 will automatically and without further action from the person operating the collapsible chair 190 be positioned in an upright position as illustrated in FIG. 8.

In contrast, when the arched sliders 150 are slid in the arched slider receiving areas 140 of the slider receptacle 130 towards the front of the collapsible chair 190, the collapsible chair 190 will automatically and without further action from the person operating the collapsible chair 190 be adjusted to a horizontal position as illustrated in FIG. 9.

Thus, the person operating the collapsible chair 190 may position or recline the collapsible chair 190 at any desired position at or between the vertical position illustrated in FIG. 8 and the horizontal position in FIG. 9 merely by adjusting where the arched sliders 150 are in relation to the arched slider receiving areas 140. The adjustment preferably occurs while the locking mechanism 500 is unlocked and the locking mechanism 500 is preferably locked during use (when the person is sitting in the chair).

The relationship of the movement of the arched sliders 150 in the arched slider receiving areas 140 to the tilt of the collapsible chair 190 may be set by the shape or degree of arch of the arched sliders 150. The greater the degree of arch of the arched sliders 150 the smaller the movement of the arched sliders 150 in relation to the arched slider receiving areas 140 needed to adjust the tilt of the collapsible chair 190. In a preferred embodiment, the two arched sliders are arched or curved and configured to maintain a center of gravity of a user over a center of the base through a range of positions of the two arched sliders sliding in the two arched slider receiving areas. In other words the center of gravity of the user sitting in the chair 190 remains over the same point over the base 100 as the chair 190 is moved between the upright position and the reclined position and all positions there between. This has the advantage of making the chair 190 stable during use no matter what position the chair 190 is in, i.e., upright, reclined or a position there between.

Once the collapsible chair 190 is in the desired tilt or position (upright, horizontal or some position there between) the locking mechanism 500 may be engaged by the user to hold the collapsible chair 190 at the desired tilt or position during use (when the person is sitting in the collapsible chair 190). As a non-limiting example, FIG. 7 illustrates an example where the tab may be lowered in the direction of arrow 700 that thereby locks the locking mechanism 500 and prevents the arched sliders 140 from moving or sliding within the arched slider receiving areas 140. The collapsible chair 190 is now locked at the desired tilt or position and the user may now use the collapsible chair 190 at the desired tilt or position created by the user.

Other embodiments and uses of the above inventions will be apparent to those having ordinary skill in the art upon consideration of the specification and practice of the invention disclosed herein. It should be understood that features listed and described in one embodiment may be used in other embodiments unless specifically stated otherwise. The specification and examples given should be considered exemplary only, and it is contemplated that the appended claims will cover any other such embodiments or modifications as fall within the true scope of the invention.

The invention claimed is:

1. A collapsible chair, comprising:

a slider receptacle mounted on a base, wherein the slider receptacle comprises two arched slider receiving areas;

two arched sliders, wherein each arched slider comprises an elongated arched pole configured to be inserted and adjustably moved in one of the two arched slider receiving areas of the slider receptacle;

two back rest poles, wherein each back rest pole comprises an elongated pole configured to form a back rest of the collapsible chair, wherein a first end of each back rest pole is removably connected by a back rest connector to the two arched sliders, wherein the first end of each back rest pole and the back rest connector is configured to removably engage and interconnect with each other, without use of a separate fastener, to form a removable interconnection between the back rest connector and each of the two back rest poles so as to enable the collapsible chair to be moved between a disassembled configuration for storage and transportation of the collapsible chair and an assembled configuration for use in various seating positions;

two seat poles configured to form a seat of the collapsible chair, wherein a first end of each seat pole is removably connected by a seat connector to the two arched sliders, wherein the first end of each seat pole and the seat connector is configured to removably engage and interconnect with each other, without use of a separate fastener, to form a removable interconnection between the seat connector and each of the two seat poles so as to enable the collapsible chair to be moved between the disassembled configuration and the assembled configuration; and a shapeable material extending between a second end of each back rest pole and a second end of each seat pole to form a sitting area of the collapsible chair, wherein the slider receptacle is configured to rotate horizontally with respect to the base while mounted on the base to thereby allow the collapsible chair to swivel from side to side.

2. The collapsible chair of claim 1, wherein each of the two arched sliders is configured to slide inside one of the two arched slider receiving areas such that when the two arched sliders are slid towards a front of the collapsible chair, the collapsible chair reclines back and when the two arched sliders are slid towards a back of the collapsible chair, the collapsible chair sits up.

3. The collapsible chair of claim 1, wherein the back rest connector is configured to removably receive the first end of each back rest pole and a first end of each arched slider.

4. The collapsible chair of claim 1, wherein the seat connector is configured to removably receive the first end of each seat pole and a second end of each arched slider.

5. The collapsible chair of claim 1, wherein the two arched sliders are arched or curved and configured to maintain a center of gravity of a user over a center of the base through a range of positions of the two arched sliders sliding in the two arched slider receiving areas.

6. The collapsible chair of claim 1, wherein the two arched sliders are curved and not straight.

7. The collapsible chair of claim 1, wherein, in the disassembled configuration of the collapsible chair, the two back rest poles are removed from the back rest connector, the two seat poles are removed from the seat connector, and the shapeable material is removed from the second end of each back rest pole and from the second end of each seat pole such that the collapsible chair is disassembled for storage and transportation.

8. The collapsible chair of claim 7, wherein, in the assembled configuration of the collapsible chair, the two back rest poles are connected by the back rest connector to the two arched sliders, the two seat poles are connected by the seat connector to the two arched sliders, and the shapeable material extends between the second end of each back rest pole and the second end of each seat pole such that the collapsible chair is assembled for use in the various seating positions.

9. The collapsible chair of claim 1, wherein one of the cooperating connection structures of the first end of each back rest pole and the back rest connector is configured to removably receive the other of the cooperating connection structures of the first end of each back rest pole and the back rest connector to form the removable interconnection between the back rest connector and each of the two back rest poles.

10. The collapsible chair of claim 9, wherein the cooperating connection structure of the back rest connector is configured to removably receive the cooperating connection structure of the first end of each back rest pole to form the removable interconnection between the back rest connector and each of the two back rest poles.

11. The collapsible chair of claim 1, wherein one of the cooperating connection structures of the first end of each seat pole and the seat connector is configured to removably receive the other of the cooperating connection structures of the first end of each seat pole and the seat connector to form the removable interconnection between the seat connector and each of the two seat poles.

12. The collapsible chair of claim 11, wherein the cooperating connection structure of the seat connector is configured to removably receive the cooperating connection structure of the first end of each seat pole to form the removable interconnection between the back rest connector and each of the two seat poles.

13. A collapsible chair, comprising:

a base comprising a plurality of legs and a leg receptacle, wherein a first end of each of the plurality of legs is configured to be removably connected to the leg receptacle and a second end of each of the plurality of legs is configured to rest upon the ground to support the base during use;

a slider receptacle mounted on the base, wherein the slider receptacle comprises two arched slider receiving areas, the slider receptacle is configured to rotate horizontally with respect to the base while mounted on the base to thereby allow the collapsible chair to swivel from side to side;

two arched sliders, wherein each arched slider comprises an elongated arched pole configured to be inserted and adjustably moved in one of the two arched slider receiving areas of the slider receptacle;

two back rest poles, wherein each back rest pole comprises an elongated pole configured to form a back rest of the collapsible chair, wherein a first end of each back rest pole is removably connected by a back rest connector to the two arched sliders, wherein the first end of each back rest pole and the back rest connector is configured to removably engage and interconnect with each other, without use of a separate fastener, to form a removable interconnection between the back rest connector and each of the two back rest poles so as to enable the collapsible chair to be moved between a disassembled configuration for storage and transportation of the collapsible chair and an assembled configuration for use in various seating positions;

two seat poles configured to form a seat of the collapsible chair, wherein a first end of each seat pole is removably connected by a seat connector to the two arched sliders, wherein the first end of each seat pole and the seat connector is configured to removably engage and interconnect with each other, without use of a separate fastener, to form a removable interconnection between the seat connector and each of the two seat poles so as to enable the collapsible chair to be moved between the disassembled configuration and the assembled configuration; and a shapeable material extending between a second end of each back rest pole and a second end of each seat pole to form a sitting area of the collapsible chair.

14. The collapsible chair of claim 13, wherein each of the two arched sliders is configured to slide inside one of the two arched slider receiving areas such that when the two arched sliders are slid towards a front of the collapsible chair, the collapsible chair reclines back and when the two arched sliders are slid towards a back of the collapsible chair, the collapsible chair sits up.

15. The collapsible chair of claim 13, wherein the back rest connector is configured to removably receive the first end of each back rest pole and a first end of each arched slider.

16. The collapsible chair of claim 13, wherein the seat connector is configured to removably receive the first end of each seat pole and a second end of each arched slider.

17. The collapsible chair of claim 13, wherein the two arched sliders are arched and configured to maintain a center of gravity of a user over a center of the base through a range of positions of the two arched sliders in the two arched slider receiving areas.

18. The collapsible chair of claim 13, wherein the two arched sliders are curved and not straight.

* * * * *